US005385273A

United States Patent [19]

Eddy et al.

[11] Patent Number: 5,385,273

[45] Date of Patent: Jan. 31, 1995

[54] HOUSING FOR LIQUID DISPENSING APPARATUS

[75] Inventors: John W. Eddy, Riverside; Kelley S. Needham, Yorba Linda, both of Calif.

[73] Assignee: Sunroc Corporation, Media, Pa.

[21] Appl. No.: 47,916

[22] Filed: Apr. 19, 1993

[51] Int. Cl.[6] ..... B67D 5/06

[52] U.S. Cl. ..... 222/185; 222/509

[58] Field of Search ..... 222/146.1, 185, 505, 222/509, 517; 251/244, 245, 246, 319, 321

[56] References Cited

U.S. PATENT DOCUMENTS

| | | | |
|---|---|---|---|
| 3,325,058 | 6/1967 | West, Jr. | 222/146.1 |
| 3,376,582 | 4/1968 | Samuels | 222/509 |
| 3,911,334 | 3/1990 | Kedzierski | 222/185 |
| 4,505,409 | 3/1985 | Armstrong | 251/245 |
| 4,909,417 | 3/1990 | Ripley | 222/185 |
| 5,192,004 | 3/1993 | Burrows | 222/185 |

*Primary Examiner*—David M. Mitchell
*Assistant Examiner*—Philippe Derakshani
*Attorney, Agent, or Firm*—John H. Crowe; F. Eugene Logan

[57] ABSTRACT

A housing for mounting on a water dispenser which includes a compartment to extend over water dispensing spigots on the dispenser. The compartment has an aperture in its top in which presser bars are positioned. The presser bars are pivotally supported by the housing and overlie the spigots to actuate them in a manner to reduce wear on and corresponding leakage of their valves. The presser bars have large areas of contact to enable them to be depressed by persons of reduced finger strength by forming a leverage system which reduces the actuating force necessary to operate the spigots.

8 Claims, 2 Drawing Sheets

FIG. 3
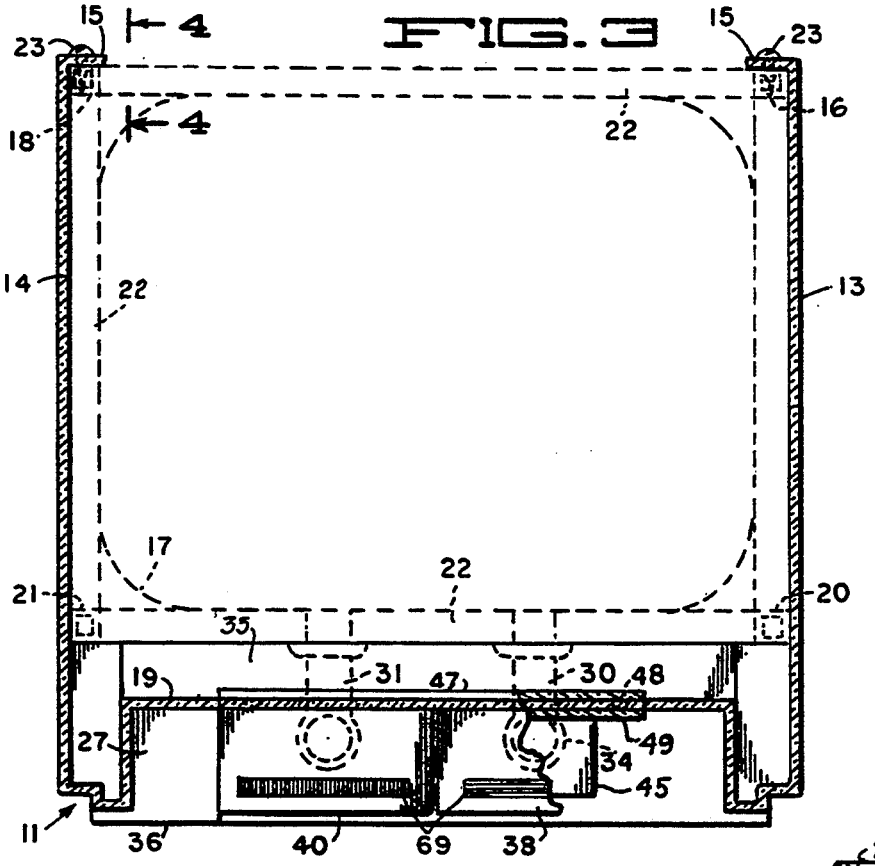
FIG. 5
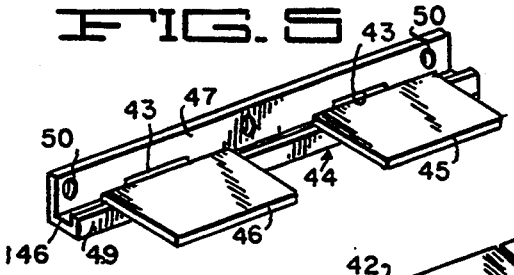
FIG. 6
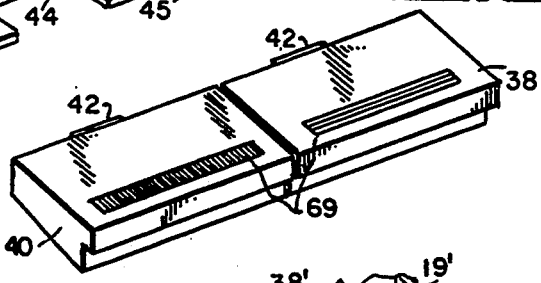
FIG. 7
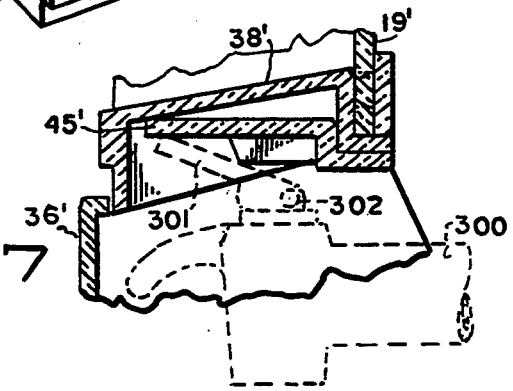
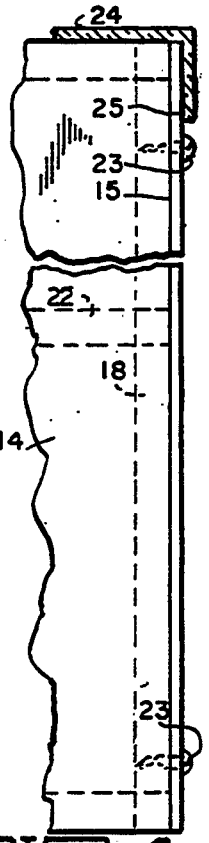
FIG. 4

HOUSING FOR LIQUID DISPENSING APPARATUS

BACKGROUND OF THE INVENTION

FIELD OF THE INVENTION

This invention relates generally to water, and other liquid, dispensing means and more particularly to such means for use in the dispensing of bottled water.

Water dispensers utilizing replenishable water supply bottles have been used for many years to provide a readily available source of pure water. Such dispensers are particularly desirable in localities where the available tap water is polluted or treated with chemicals. Some of these dispensers have been provided with a heating unit to dispense hot water and others with cooling units to dispense cold water. Still others, have simply dispensed water at ambient or room temperature. Such dispensers have therefore had from one to three or more controllable spigots to enable a person to obtain water of a desired temperature in a suitable drinking glass or the like.

Although dispensers of the above-noted type have been generally satisfactory their use has presented certain problems which have not been heretofore addressed to my knowledge. For example, the spigots of such dispensers have generally comprised elongate sliding valve members which are pressed endwise to open them. However, persons depressing such a valve member tend to push it at different angles to the direction of its movement instead of directly in line with that movement. This eventually results in wear along the sides of the valve member and its guideway, and consequent leakage of water thereat.

Further, such valve members must be held in valve seating positions by springs of sufficient strength to prevent leakage when not in use. Consequently, a certain amount of manual force is required to move a valve member to open a spigot. Heretofore, such valve members usually terminated in finger-operated push buttons or levers which required considerable finger pressure to operate, thus presenting a hardship to elderly persons, those afflicted with a crippling disease, or anyone having low finger strength.

In addition, dispensers of the above type have generally included spigots which extended into the open where dirt and dust from the atmosphere or from persons handling the spigot can collect to give it an unclean appearance and possibly contaminate water being dispensed therefrom.

It is therefore a principal object of the present invention to provide means for overcoming the above-noted drawbacks of conventional liquid dispensers.

Another object of the invention is to reduce wear on, and consequent leakage of, spigots for liquid dispensers of the above-noted type.

Still another object of the invention is to provide a housing for a water dispenser including means for enabling a person of low finger strength to readily control the dispensing spigot or spigots of the dispenser.

A further object of the invention is to provide a liquid dispensing apparatus of the above-indicated type with means for minimizing contamination of its spigot(s) by dust and dirt from the atmosphere or by persons using it.

A still further object of the invention is to provide a housing which can be mounted on dispensers of different makes and having different numbers of spigots.

Yet another object of the invention is to provide a housing of the above-noted type which is of simple and economical construction, has a pleasing aesthetic appearance and can be readily cleaned.

SUMMARY OF THE INVENTION

According to the invention, a housing or casing is provided for at least substantially enclosing a liquid dispensing apparatus, the housing including a front panel adapted to be mounted on the frame of a conventional dispenser having one or more liquid dispensing spigots. Depressible dispenser bars having fairly large contact areas are pivotally supported by the panel so that persons of reduced finger strength can readily depress spigot valve members on the dispensing apparatus by using a plurality of fingers or a hand.

Although the dispenser bars can be depressed from different angular approaches, the bars themselves will invariably depress the spigot valve members substantially in the direction of their lengths and thus reduce side wear thereon and consequent spigot leakage at the worn areas.

The aforesaid housing forms a compartment which, along with the presser bars, covers the dispenser spigots and adjacent parts of the dispenser to prevent dust and dirt from settling thereon to a large extent and minimize the possibility of persons touching the spigots and spigot openings.

BRIEF DESCRIPTION OF THE DRAWING

The manner in which the above and other objects of the invention are accomplished will be readily understood from the following specification considered in conjunction with the accompanying drawing, wherein:

FIG. 3 is a sectional plan view of the housing taken along line 3—3 of FIG. 1.

FIG. 4 is a sectional view, with parts broken away, of part of the housing, taken along line 4—4 of FIG. 3.

FIG. 5 is a perspective view of a spigot operating lever member forming part of the present invention.

FIG. 6 is a perspective view of presser bars forming another part of the invention.

FIG. 7 is a sectional view similar to FIG. 2 but illustrating the housing mounted on a dispenser having another form of spigot.

DESCRIPTION OF THE PREFERRED EMBODIMENT

Figure 1:
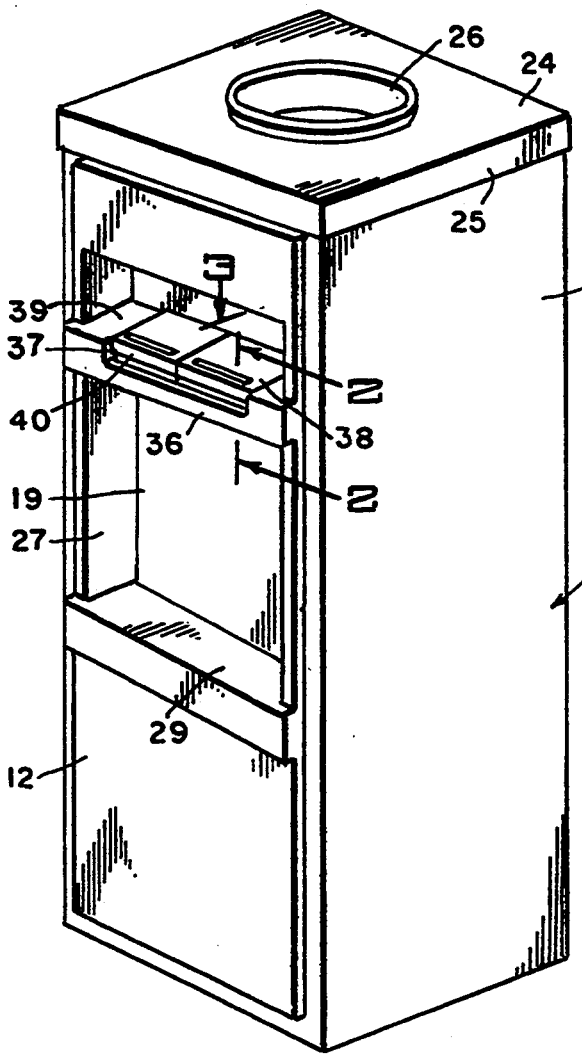
FIG. 1 is a perspective view of a water dispenser housing embodying a preferred form of the present invention.

Referring to the drawings, a housing is shown generally at 11 comprising a front panel 12 and integral side panels 13 and 14 having inturned flanges 15 which extend along the lengths thereof.

Figure 2:
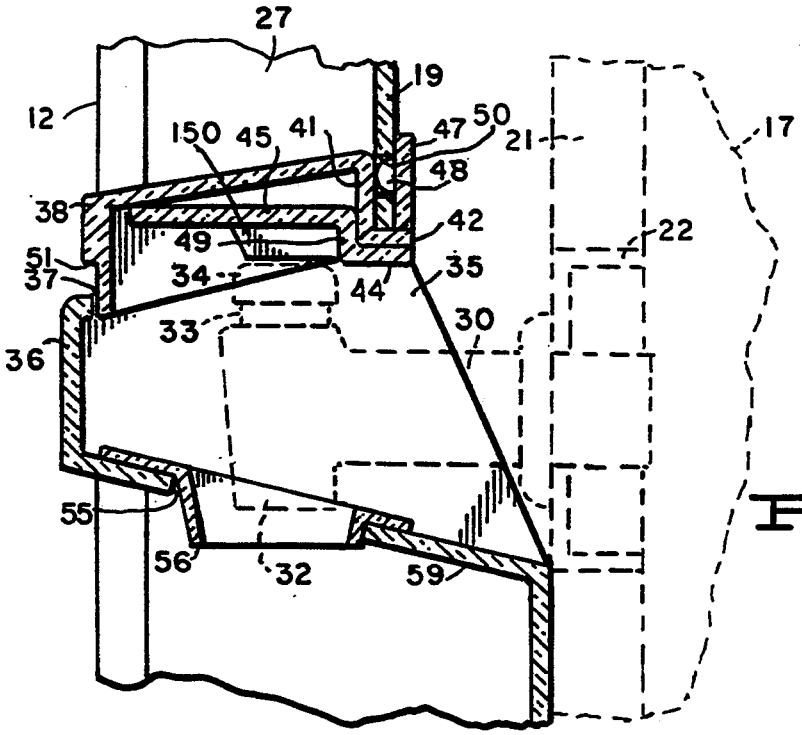
FIG. 2 is an enlarged fragmentary sectional view taken along line 2—2 of FIG. 1.

A water or other liquid dispenser 17 of conventional construction, partly depicted by dashed lines (FIG. 2 and 3), is shown mounted in a frame, also of conventional construction, comprising four upright tubular posts 16, 18, 20 and 21 suitably attached to cross frame pieces 22. The housing 11 is removably attached to the frame by screws 23 passing through the flanges 15 and threaded into the posts 16 and 18. A lid 24 having depending flanges 25 therearound is fitted over the upper ends of the panels 12, 13 and 14. The lid has an opening 26 therein to receive the mouth of an inverted water supply bottle (not shown) to permit the bottle to empty into the open upper end of the water dispenser.

Water dispenser 17 includes suitable liquid heating and cooling means (not shown) and a pair of forwardly extending spigots 30 and 31 of conventional type (FIG. 2 and 3) to dispense hot and cold water, respectively. Each spigot has a depending spout 32 and an endwise vertically moveable valve member 33 terminating in a push button 34 whereby depression of the push button actuates the valve member to effect the flow of water through spout 32.

The front panel 12 has a recessed section 27 and a compartment 36 is positioned to extend outwardly from the rear wall 19 of said suction. The bottom of the recessed panel section 27, shown at 29, forms a shelf to support a glass or cup (not shown) to receive liquid from either of the spigots.

When the housing 11 is secured in place, the compartment 36 extends around and substantially covers the spigots 30 and 31 which are positioned to extend through an opening 38 in the rear wall 19 of recessed section 27 of front panel 12.

An aperture 37 is formed in the top wall 39 of compartment 36 to receive a pair of presser bars 38 and 40, preferably formed of a flexible plastic material such as polypropylene. Each presser bar is formed with a depending lip 41 at its rear and a rearwardly extending tongue 42 (see FIG. 2 and 6). The tongue fits within a socket 43 (FIG. 5) in a lever member 44 also preferably formed of flexible plastic material. Two lever arms 45 and 46 extend forwardly from the member 44 to underlie respective ones of the bars 38 and 40. Pads 150 on the lever arms respectively overlie the push buttons 34.

It will be seen that lever member 44 is provided with a channel 146 formed by an upwardly extending lip 47 and a wall 49 to receive the lip 41 and clamp it against the forward side of the panel wall 19. Dimples 48 on the lip 47 snap into openings 50 in the panel wall 19 to removably lock the lever member 44 and presser bars 38 and 40 in place.

Due to the resilient nature of the material forming the lever member 44 and presser bars 38 and 40, they tend to pivot about the respective lips 41 and wall 49 when depressed.

Each of the bars 38 and 40 is provided with a shoulder 51 which upon depression of the bar limits against the upper wall 39 of the compartment 36 to limit the extent of movement of its associated spigot valve member 33.

It will be evident from the foregoing that each of the presser bars 38 and 40 extends forwardly beyond a respective push button 34 to form a lever to reduce the force necessary to depress the underlying valve member. Further, each presser bar is formed with a considerably greater area than that of the underlying push button enabling a person with reduced finger strength to easily actuate the valve member by using either multiple fingers or his or her hand. It will be evident that regardless of the angle at which finger pressure is applied to a presser bar, the lever arm (45 in FIG. 2) will always apply a substantially vertical actuating force to the underlying push button thereby greatly reducing any side wear on the respective valve member.

Openings 55 (see FIG. 2) are formed in the bottom wall 59 of compartment 36 to permit liquid flow from spigots 30 and 31. To minimize the possibility of persons touching and possibly contaminating the bottoms of the spigot spouts 32, a surrounding shroud 56 is suitably secured at each of the openings 55 to extend below the level of the respective spigot spout 32. Identifying strips 69 of different colors are formed on the presser bars 38 and 40 to indicate hot and cold water, or the like, valve positions.

It will be appreciated that casing 11 can be readily modified for use on water dispensers having a greater or lesser number of spigots than dispenser 17 by removing the lever member 44 and presser bars 38 and 40 therefrom and replacing them with another lever member having a desired number of lever arms such as lever arms 45 and 46 and a matching number of overlying presser bars. Moreover, the housing 11 can be readily mounted on a water dispenser having spigots different from the one shown in FIG. 2. FIG. 7, for example, illustrates such a dispenser with a spigot 300 having a valve operating lever 301 pivoted thereto at 302 and arranged to underlie an actuating lever arm 45'.

Although the housing panels 12, 13 and 14 are preferably formed integral with each other, they could be formed separately and secured together by suitable means, if desired.

From the above it will be seen that I have provided an improved housing which can be readily attached to any conventional water dispenser with little or no modification. Cooperating presser bars can then be pivotally supported by the housing in a manner to provide a force reducing leverage for water dispensing purposes and a relatively large contact area to permit the opening of spigot valves without difficulty by persons having limited finger strength. This unique structural arrangement also results in reduced wear on spigot valve members and minimizes the accumulation of dirt and dust on the dispensing apparatus while providing a pleasing appearance which can be readily cleaned.

We claim:

1. A housing for a liquid dispenser, which dispenser has a frame and liquid dispensing means including at least one spigot carried by said frame, said spigot having a valve member moveable endwise for controlling the flow of liquid through the spigot, said housing comprising:

a panel having an opening therein for receiving at least a part of said spigot, means for mounting said panel on the frame, and presser means pivotally supportable by said panel so as to overlie said valve member whereby depression thereof actuates said valve member, said presser means including a lever member adapted to reduce the amount of force required to move said valve member, wherein said panel includes a compartment surrounding said opening and adapted to enclose at least a part of said at least one spigot, said compartment having an aperture therein to receive said presser means, and wherein said presser means is formed of flexible material adapted to flex when it is depressed.

2. A housing as defined in claim 1 including means on said compartment for limiting the extent of depression of said presser means.

3. A housing as defined in claim 2 wherein said compartment extends below said spigot to minimize the tendency of persons to touch the spigot, said compartment having a second aperture therein to allow liquid to be dispensed from said spigot therethrough.

4. A housing as defined in claim 3 wherein said lever member overlies said valve member, and said presser means also includes:

means securing a portion of said lever member to said panel, presser bar means of flexible material overlying said lever member in said aperture, and means securing a portion of said presser bar means to said panel.

5. A housing as defined in claim 4 wherein:

said lever member has a first lip passable through said opening and yieldably engageable with one side of said panel for clamping a portion of said presser bar means against the opposite side of said panel, and which includes interlocking means between said lip and said panel for helping secure said lever member and said presser bar means to said panel.

6. A housing as defined in claim 5 wherein said presser bar means has a second lip adapted to engage said opposite side of said panel, and said first lip serves to secure said second lip to said panel.

7. A housing in accordance with claim 6 in which said at least one spigot comprises a plurality of spigots carried by said frame, each having a valve member moveable endwise for controlling the flow of liquid therethrough;

said opening in said panel serves to receive at least a part of each of said spigots, and said presser bar means comprises a plurality of depressible presser bar devices pivotally supported by said panel and arranged to overlie respective ones of the valve members whereby depression of any one of the presser bar devices will actuate a corresponding valve member, said presser bar devices serving as levers to reduce the force required to move respective ones of said valve members.

8. A housing as defined in claim 7 wherein said aperture is adapted to receive said presser bar devices in side by side relationship.

* * * * *